US006860135B2

(12) United States Patent
Yoshioka et al.

(10) Patent No.: US 6,860,135 B2
(45) Date of Patent: Mar. 1, 2005

(54) METHOD FOR REMOVING STRAIN FROM PRESS-FORMED WORKPIECE, AND FORMING PRESS

(75) Inventors: Naoki Yoshioka, Okazaki (JP); Kenichi Kusunoki, Toyota (JP); Yuichi Yagami, Susono (JP); Mikio Wada, Aichi-ken (JP); Tsuyoshi Takahashi, Aichi-ken (JP)

(73) Assignee: Araco Kabushiki Kaisha

( * ) Notice: Subject to any disclaimer, the term of this patent is extended or adjusted under 35 U.S.C. 154(b) by 0 days.

(21) Appl. No.: 10/360,970

(22) Filed: Feb. 6, 2003

(65) Prior Publication Data

US 2003/0145643 A1 Aug. 7, 2003

(30) Foreign Application Priority Data

Feb. 7, 2002 (JP) ..... 2002-030394

(51) Int. Cl.[7] ..... B21B 22/22
(52) U.S. Cl. ..... 72/348; 72/350
(58) Field of Search ..... 72/296, 297, 308, 72/348, 350, 351

(56) References Cited

U.S. PATENT DOCUMENTS 1,035,984 A * 8/1912 Malde ..... 72/329
5,823,040 A * 10/1998 Stodd ..... 72/329
6,276,185 B1 * 8/2001 Owens ..... 72/350
6,508,096 B1 * 1/2003 Carlile ..... 72/297

FOREIGN PATENT DOCUMENTS

| | | | | |
|---|---|---|---|---|
| DE | 198 42 750 | | 4/2000 | |
| DE | 198 53 130 | | 5/2000 | |
| EP | 1 136 149 | | 9/2001 | |
| JP | 4-190931 | * | 7/1992 | 72/350 |
| JP | 2001-259752 | | 9/2001 | |

* cited by examiner

*Primary Examiner*—Lowell A. Larson
(74) *Attorney, Agent, or Firm*—Fish & Richardson P.C.

(57) ABSTRACT

In a forming press, a blank is pressed formed into a press-formed workpiece by means of an upper die and a lower die, while a peripheral edge portion of the blank is clamped by means of a die and a blank holder insert of the forming press. Subsequently, a central portion of the press-formed workpiece is partially held by means of the upper die and the lower die so as to draw a peripheral portion of the press-formed workpiece away from the central portion thereof, thereby removing strain from the press-formed workpiece.

6 Claims, 8 Drawing Sheets

METHOD FOR REMOVING STRAIN FROM PRESS-FORMED WORKPIECE, AND FORMING PRESS

BACKGROUND OF THE INVENTION

1. Field of the Invention

The present invention relates to a method for removing strain from a press-formed workpiece and to a forming press capable of carrying out the method.

2. Description of the Related Art

In many cases, strain remains in a press-formed workpiece or in a product obtained through finishing of the workpiece. Therefore, strain must be removed from the press-formed workpiece. Particularly, when a thin metal plate is subjected to press forming, removal of strain is very important. A product obtained through press forming of a thin metal plate (not greater than 0.5 mm in thickness) is, for example, a separator for use in a fuel cell (as well as an article disclosed in Japanese Patent Application Laid-Open (kokai) No. 2001-259752).

As shown in the enlarged schematic view of FIG. 13, a separator 1 for use in a fuel cell has many projections and recesses 1 a formed at its central portion. The separators 1 and electrolyte membranes 2 are arranged such that each electrolyte membrane 2 is sandwiched between the separators 1 to thereby form reaction chambers 3, into which hydrogen is introduced, and reaction chambers 4, into which oxygen is introduced, while the separators 1 are directly joined back-to-back to thereby form cooling chambers 5, into which cooling water is introduced. In order to achieve good joining of the two separators 1 and of the separator 1 and the electrolyte membrane 2, press-formed workpieces which are finished into the separators 1 must be free of strain. Also, other products obtained through press forming must be free of strain, and the same applied to press-formed workpieces which are finished into the products.

SUMMARY OF THE INVENTION

In view of the foregoing, an object of the present invention is to provide a method for removing strain from a press-formed workpiece as well as a forming press capable of carrying out the method.

To achieve the above object, the present invention provides a method for removing strain from a press-formed workpiece, comprising the step of drawing a peripheral portion of a press-formed workpiece away from a central portion thereof while maintaining the press-formed workpiece in a pressed state, so as to impart plastic deformation to the press-formed workpiece, to thereby remove strain from the press-formed workpiece. Strain can be readily removed from the press-formed workpiece, simply by means of subjecting the press-formed workpiece to drawing while the press-formed shape of the press-formed workpiece is maintained intact (while the press-formed workpiece is maintained in a pressed state).

The present invention also provides a method for removing strain from a press-formed workpiece, comprising the step of: providing a press-formed workpiece which is obtained by pressing a blank in a press direction, while clamping a peripheral edge portion of the blank, by use of a forming press; and partially holding a central portion of the press-formed workpiece and moving the central portion in a press direction so as to draw a peripheral portion of the press-formed workpiece away from the central portion for imparting plastic deformation to the press-formed workpiece, to thereby remove strain from the press-formed workpiece. Thus, the step of removing strain (the step of drawing in the press direction) can be readily incorporated into the press-forming process.

Preferably, the press-formed workpiece is a thin metal plate having a number of projections and recesses formed at a central portion thereof. Preferably, the amount of drawing is substantially equal to a difference between a sectional length as measured at a portion of the press-formed workpiece where the projections and recesses are present and a sectional length as measured at a portion of the press-formed workpiece where the projections and recesses are absent. Employment of the thus-determined amount of drawing allows formation of a number of projections and recesses on the workpiece without involvement of cracking of the workpiece. Therefore, strain can be removed from the press-formed workpiece without involvement of cracking of the press-formed workpiece.

Preferably, a peripheral edge portion is cut off from the press-formed workpiece which has undergone the drawing work, so as to yield a platelike product. Since the peripheral edge portion, in which the influence of strain-removing work remains to a great extent, is cut off, the influence of strain-removing work hardly remains in the obtained plate-like press-formed product.

The present invention also provides a forming press comprising a movable section which enables drawing a peripheral portion of a press-formed workpiece away from a central portion thereof while the press-formed workpiece is pressed by an upper die and a lower die. Thus, the forming press can remove strain from the press-formed workpiece while the press-formed shape of the press-formed workpiece is maintained intact (while the press-formed workpiece is maintained in a pressed state).

Preferably, the upper die lowers toward the lower die so as to press-form a central portion of a workpiece; the movable section is disposed under the lower die and serves as a cushion mechanism for allowing a lowering movement of the upper and lower dies; and the movable section receives reaction force when the peripheral portion of the press-formed workpiece is drawn away from the central portion of the press-formed workpiece. Employment of this configuration allows the movable section to be compactly incorporated into the forming press under the lower die and to serve as the cushion mechanism.

Preferably, an edge portion of a press die is rounded, the edge portion being in contact with the press-formed workpiece in a relatively movable manner when the peripheral portion surrounding the central portion of the press-formed workpiece is drawn away from the central portion. This rounded edge portion allows smooth relative movement between the press die and the press-formed workpiece, whereby strain can be smoothly removed from the press-formed workpiece.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENT

Figure 1:
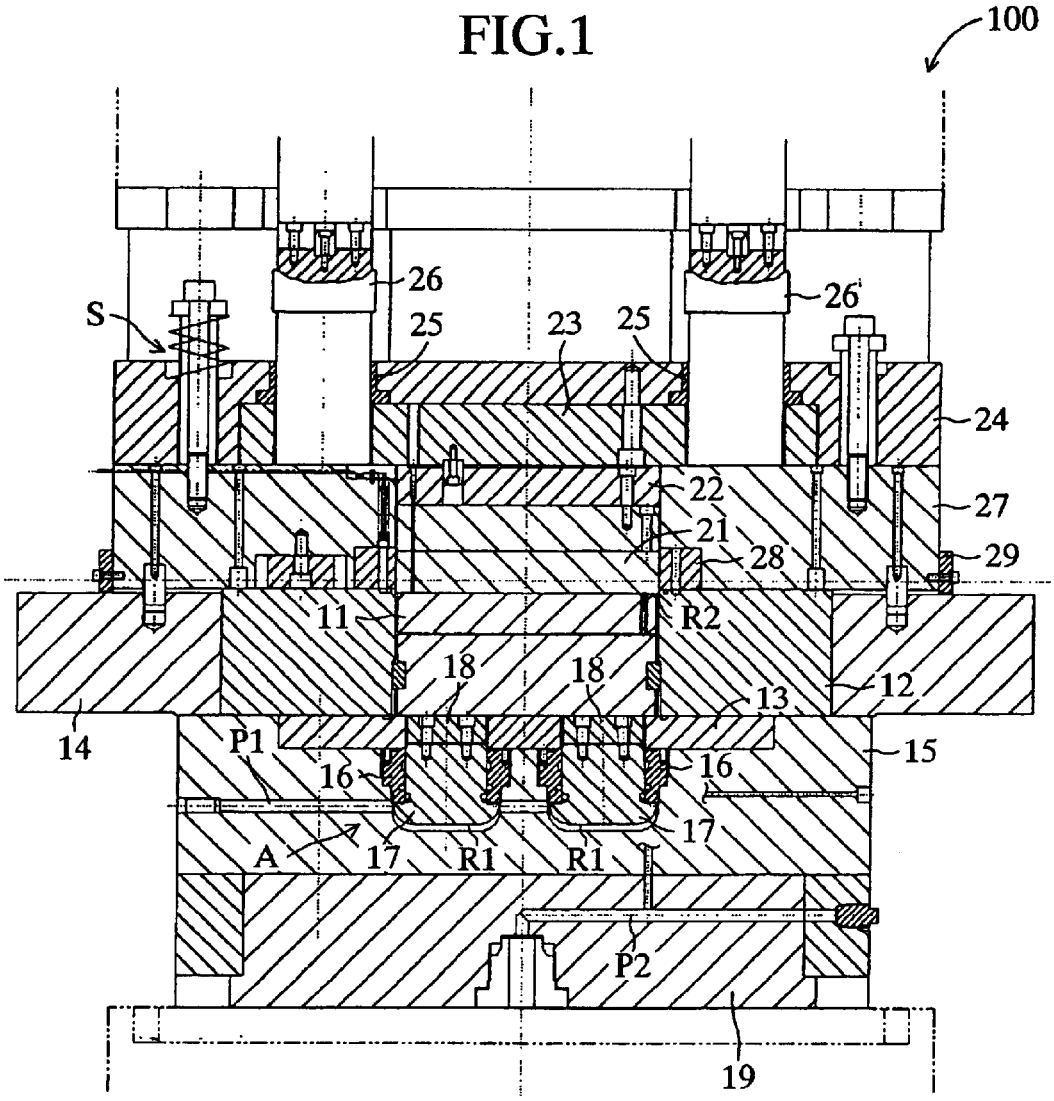
FIG. 1 is a vertical sectional view of a forming press according to an embodiment of the present invention, in which an upper die and a lower die are at the bottom dead center.

An embodiment of the present invention (a method and forming press for manufacturing a press-formed workpiece which is to be formed into a separator for use in a fuel cell) will next be described with reference to the drawings. FIG. 1 shows a forming press 100 of the present embodiment in which a lower die 11 and an upper die 21 are at the bottom dead center. The lower die 11 is of two layers consisting of an upper layer and a lower layer and is accommodated in a die 12 in a vertically movable manner. Upon abutment with a backing plate 13, the lower die 11 is prevented from lowering further. The die 12, together with a die ring 14, is mounted on the backing plate 13 and a cushion cylinder base 15.

In the cushion cylinder base 15, a pair of cushion bushes 16, a pair of cushion rams 17, a pair of cushion liners 18, etc. constitute a cushion mechanism A. The cushion cylinder base 15 is mounted on a lower-die block 19. The cushion bushes 16 are fixedly attached to the cushion cylinder base 15 in a liquid-tight manner and support the corresponding cushion rams 17 such that the cushion rams 17 can move vertically.

The cushion rams 17 are fitted into the corresponding cushion bushes 16 in a liquid-tight manner and in a vertically movable manner and form respective pressure chambers R1 in the cushion cylinder base 15. The cushion rams 17 integrally support the corresponding cushion liners 18. Operating oil fed into the pressure chambers R1 causes the cushion rams 17 to move upward and abut the corresponding cushion bushes 16. When the cushion rams 17 abut the corresponding cushion bushes 16, the cushion liners 18 project upward from the upper surface of the backing plate 13 by 0.5–1.0 mm (substantially equal to a difference in a sectional length of a press-formed workpiece W which arises from local presence and absence of projections and recesses W1*a*; i.e., a difference between sectional length La as measured at a portion of the press-formed workpiece W where the projections and recesses W1*a*; are present and sectional length Lb as measured at a portion of the press-formed workpiece W where the projections and recesses W1*a* are absent).

The cushion liners 18 are provided within corresponding through-holes formed in the backing plate 13, in such a manner as to be able to pass through the through-holes. When operating oil is fed into the pressure chambers R1, the cushion liners 18 project upward from the upper surface of the backing plate 13 and support the lower die 11 from underneath. When operating oil is drained from the pressure chambers R1, the cushion liners 18 retract below the upper surface of the backing plate 13 apart from the lower surface of the lower die 11.

Figure 10:
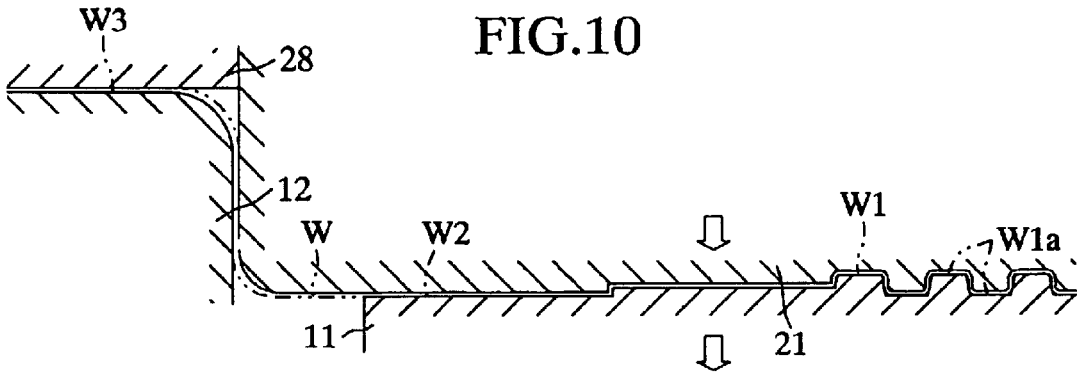
FIG. 10 is an enlarged vertical sectional view of the main portion of the forming press of FIG. 1 in a strain removing step.

The cushion mechanism A is disposed under the lower die 11 and allows the lower die 11 and the upper die 21 to lower from the press-forming position (the position of FIG. 8) to the bottom dead center (the position of FIG. 10 where the lower die 11 abuts the upper surface of the backing plate 13). The cushion mechanism A is subjected to reaction when a peripheral portion W2 (a portion which surrounds a central portion W1) of the press-formed workpiece W shown in FIG. 11 is drawn away from the central portion W1 (when the state of FIG. 8 is shifted to the state of FIG. 10).

An oil path P1 is formed in the cushion cylinder base 15 in order to feed operating oil into or drain operating oil from the pressure chambers R1. A liquid path P2 is formed in the cushion cylinder base 15 and the lower-die block 19 in order to feed operating liquid (e.g., oil or water) into or drain operating liquid from a pressure chamber R2 formed between the press-formed workpiece W and the lower die 11 (see FIGS. 4 and 6).

The upper die 21 is of two layers consisting of an upper layer and a lower layer and is fixedly attached to a vertically movable upper-die block 24 via a punch spacer 22 and a punch backing plate 23, whereby the upper die 21 and the upper-die block 24 move vertically as a unit. Rods 26 are attached to the upper-die block 24 in a vertically movable manner via corresponding rod guides 25. A blank holder 27, a blank holder insert 28, and a liquid-scattering prevention cover 29 are integrally attached to the rods 26. Spring units S intervene between the upper-die block 24 and the blank holder 27 so as to resiliently allow their relative vertical movement.

Figure 2:
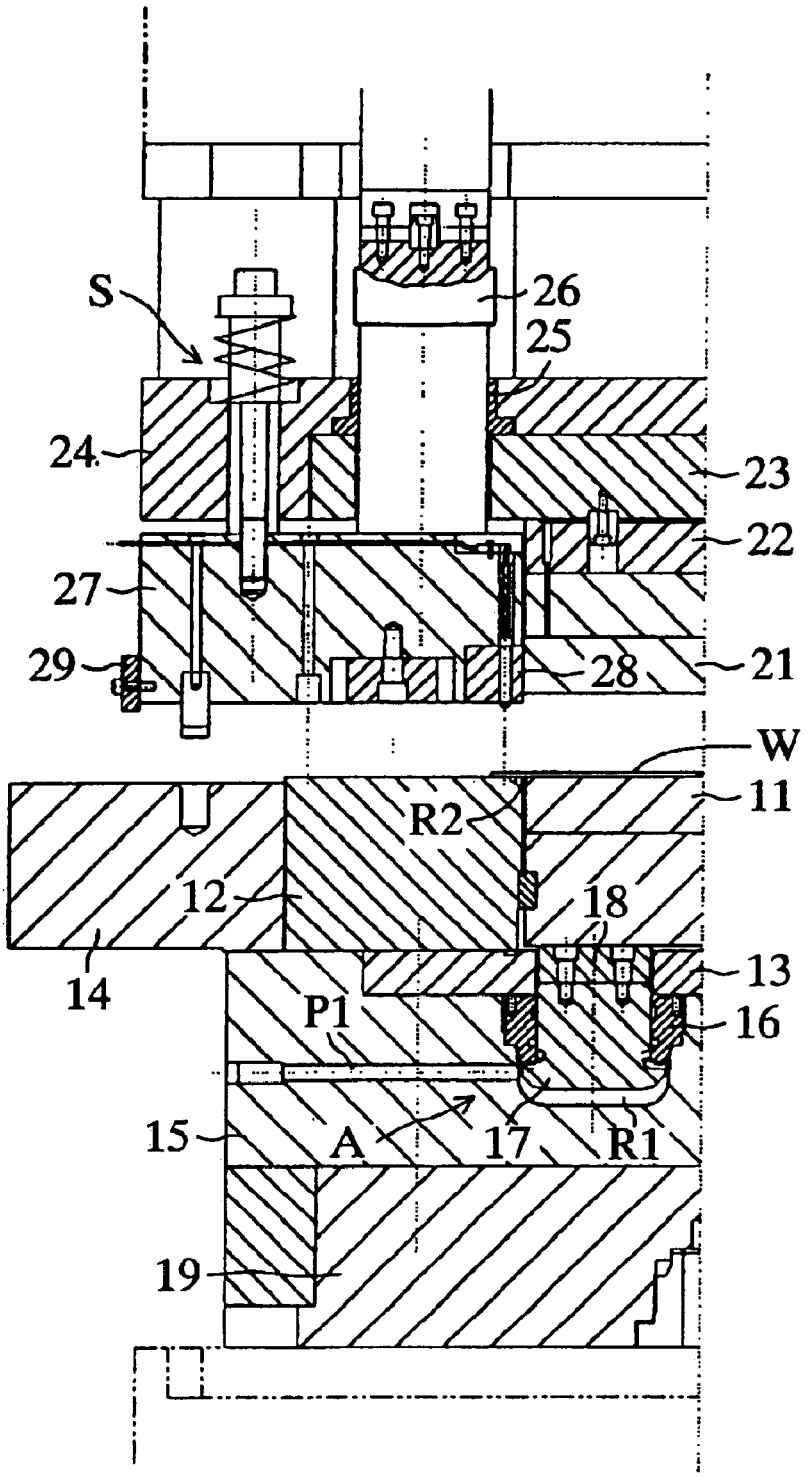
FIG. 2 is a vertical sectional view of a main portion of the forming press of FIG. 1 in a blank setting step.
Figure 3:
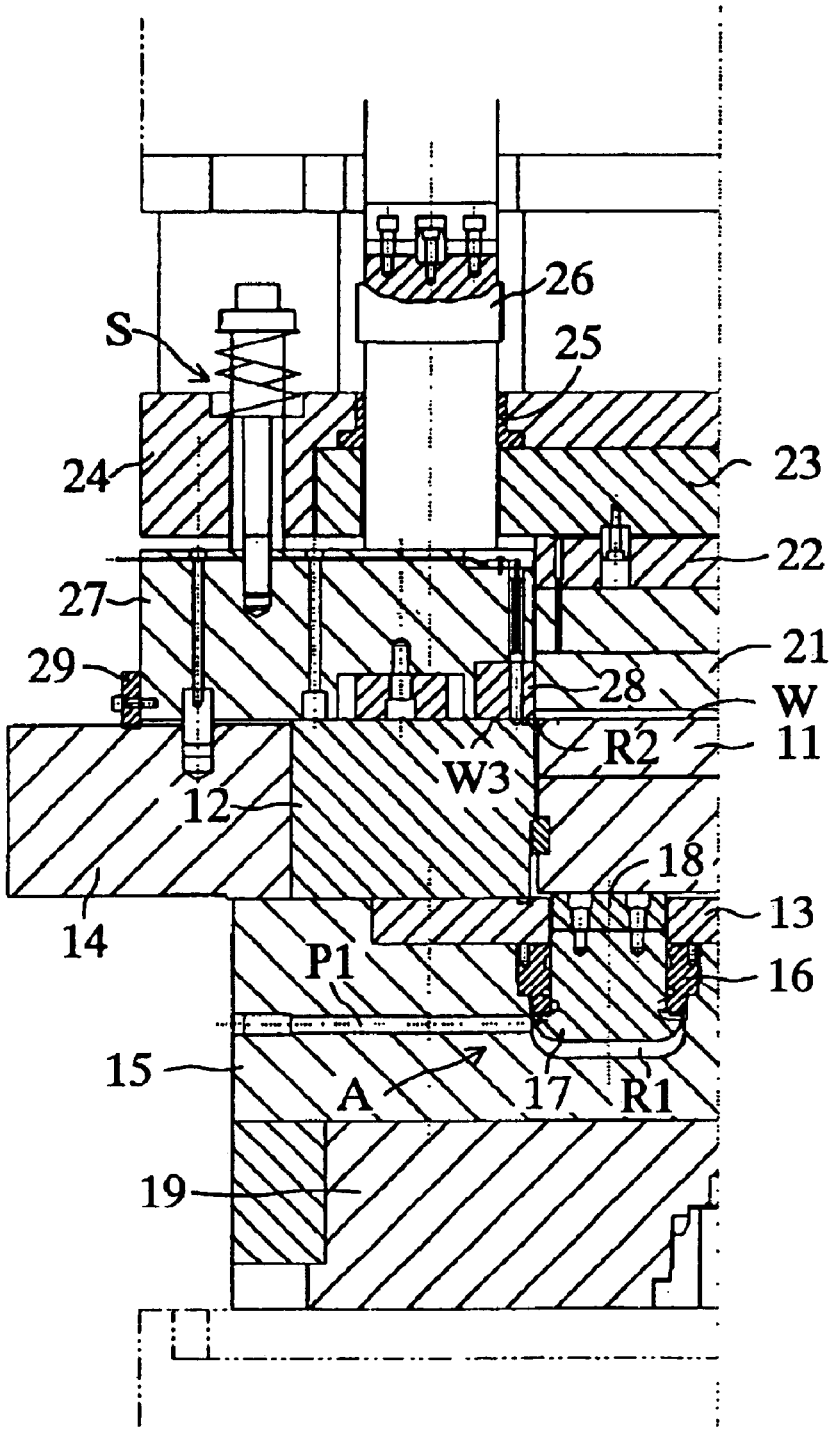
FIG. 3 is a vertical sectional view of the main portion of the forming press of FIG. 1 in a blank clamping step.
Figure 4:
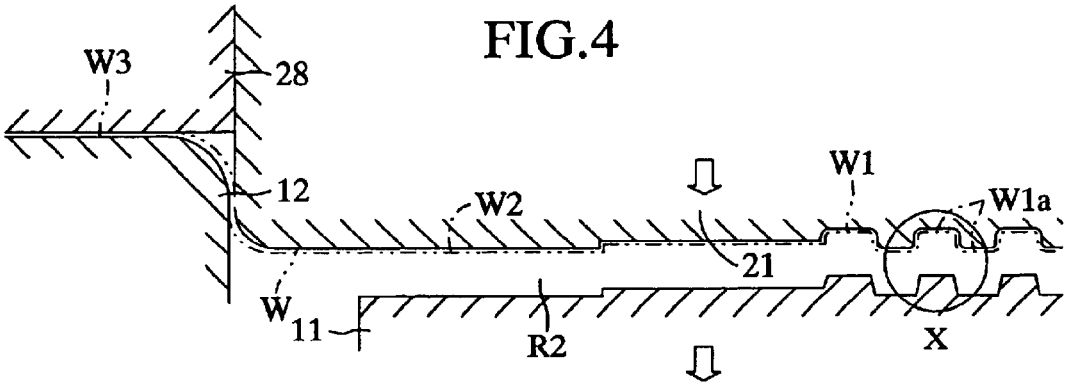
FIG. 4 is an enlarged vertical sectional view of the main portion of the forming press of FIG. 1 in a hydroforming step.
Figure 6:
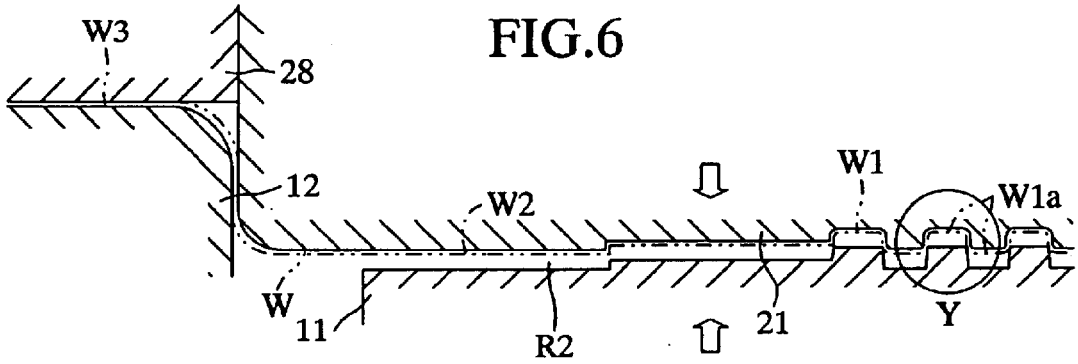
FIG. 6 is an enlarged vertical sectional view of the main portion of the forming press of FIG. 1 in a hydrorestriking step.
Figure 8:
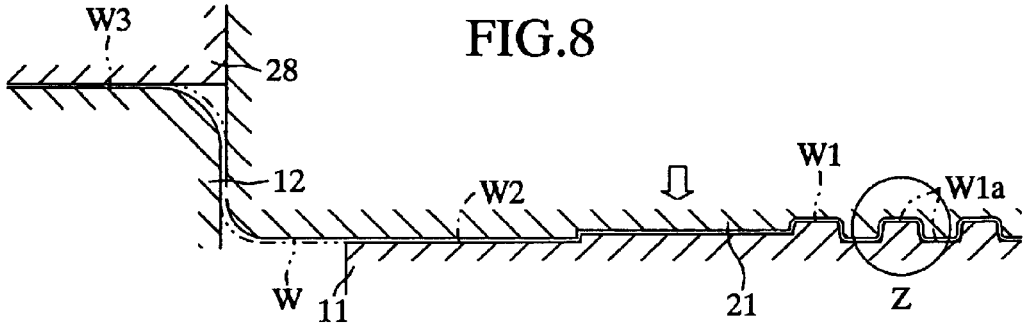
FIG. 8 is an enlarged vertical sectional view of the main portion of the forming press of FIG. 1 in a restriking step.
Figure 11:
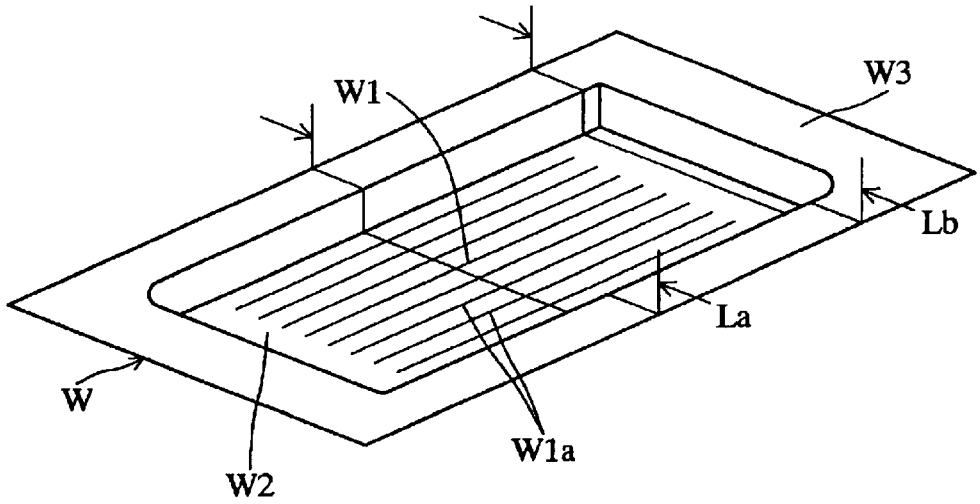
FIG. 11 is a schematic perspective view of a press-formed workpiece which is manufactured through press forming by means of the forming press of FIG. 1.
Figure 12:
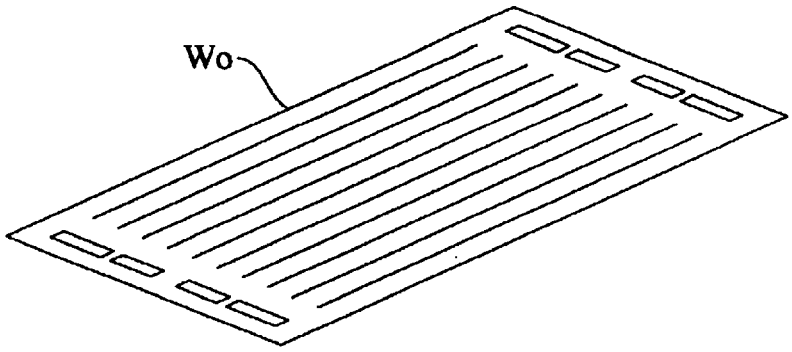
FIG. 12 is a schematic perspective view of a flat product obtained from the press-formed workpiece of FIG. 11 and serving as a separator for use in a fuel cell.
Figure 13:
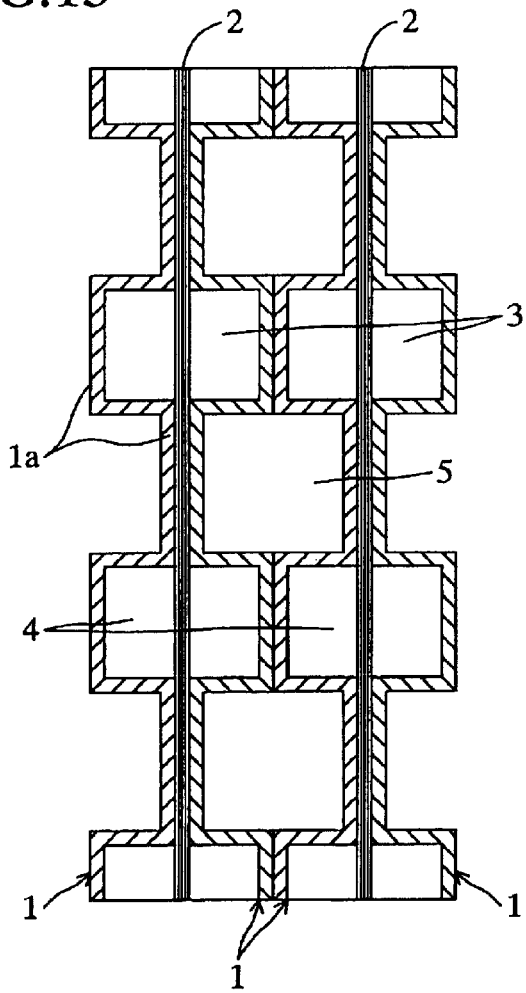
FIG. 13 is a schematic sectional view of a main portion of a fuel cell which employs separators of FIG. 12.

The thus-configured forming press 100 of the present embodiment is adapted to form the press-formed workpiece W shown in FIG. 11 by the method consisting primarily of: a blank setting step shown in FIG. 2; a blank clamping step shown in FIG. 3; a hydroforming step shown in FIG. 4; a hydrorestriking step shown in FIG. 6 (a die forming step in the presence of operating liquid); a restriking step shown in FIG. 8 (a die forming step in the absence of operating liquid); and a strain removing step shown in FIG. 10.

In the blank setting step shown in FIG. 2, while component members associated with the upper die 21 are raised by a predetermined amount above the position of FIG. 1, a flat blank (a thin metal plate having a thickness not greater than 0.5 mm), which is to be formed into the press-formed workpiece W, is set on the die 12 in such a manner as to cover the lower die 11. In this state, operating oil of a predetermined pressure (a relief pressure determined by an unillustrated relief valve) is fed into the pressure chambers R1, so that the lower die 11 is held at a position located above the bottom dead center by a predetermined amount (0.5–1.0 mm). The pressure chamber R2 is filled with operating liquid, thereby preventing entry of air into the pressure chamber R2.

In the blank clamping step shown in FIG. 3, the flat blank, which is to be formed into the press-formed workpiece W, is clamped at its peripheral edge portion W3 (see FIG. 11) by means of the die 12 and the blank holder insert 28. Also, in this state, the supply of operating oil of a predetermined pressure to the pressure chambers R1 is continued; the lower die 11 is held at a position located above the bottom dead center by a predetermined amount (0.5–1.0 mm); and the pressure chamber R2 is filled with operating liquid. The upper die 21 is situated slightly above the flat blank and thus is not in contact with the flat blank.

Figure 5:
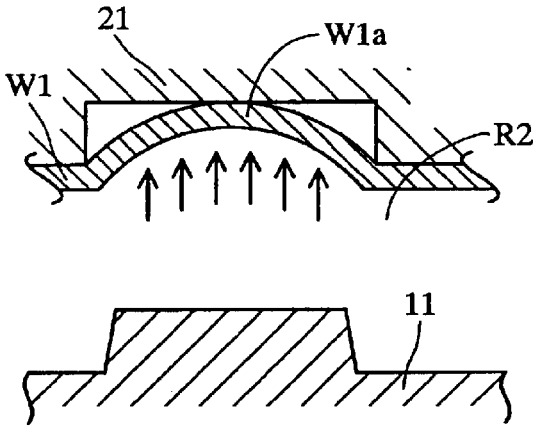
FIG. 5 is an enlarged sectional view of portion "X" of FIG. 4.

In the hydroforming step shown in FIG. 4, the upper die 21 is lowered by a predetermined amount below the blank holder insert 28 (0.7–1.2 mm above the bottom dead center) and held at the position. Pressurized operating liquid is fed into the pressure chamber R2 so as to form a number of projections and recesses W1*a* at the central portion W1 (see FIG. 11) of the press-formed workpiece W as shown in FIG. 5 by means of the operating liquid and the upper die 21. In this state, the pressure of operating liquid fed into the pressure chamber R2 is higher than that (relief pressure) of operating oil fed into the pressure chambers R1; thus, operating oil is relief-drained from the pressure chambers R1. Therefore, the lower die 11 lowers to the bottom dead center.

Figure 7:
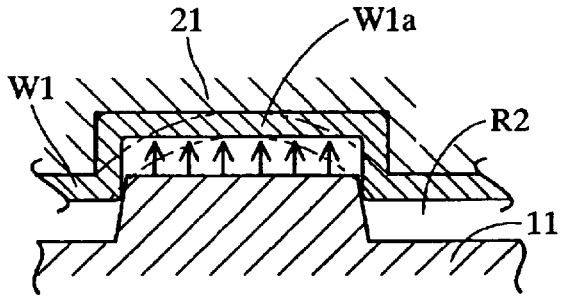
FIG. 7 is an enlarged sectional view of portion "Y" of FIG. 6.

In the hydrorestriking step shown in FIG. 6, operating liquid in the pressure chamber R2 is not pressurized (operating liquid is released from pressurization and thus is ready to be drained). The upper die 21 is lowered by a predetermined amount (0.1 mm) from the position of FIG. 4. Also, in this state, the supply of operating oil of a predetermined pressure to the pressure chambers R1 is continued; thus, the lower die 11 which has once lowered to the bottom dead center as shown in FIG. 4, is raised by a predetermined amount (0.5–1.0 mm) above the bottom dead center. As a result, the lower die 11 comes into contact with the press-formed workpiece W, whereby, while operating liquid is present within the pressure chamber R2 between the lower die 11 and the press-formed workpiece W, a number of projections and recesses W1*a* are formed through bulging by means of the upper die 21 and the lower die 11 as shown in FIG. 7.

Figure 9:
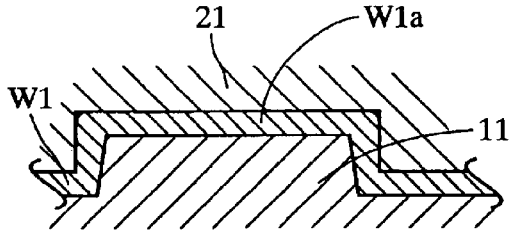
FIG. 9 is an enlarged sectional view of portion "Z" of FIG. 8.

In the restriking step shown in FIG. 8, in the state in which operating liquid can be drained from the pressure chamber R2, the upper die 21 is lowered by a predetermined amount (0.1 mm) from the position of FIG. 6, so that the lower die 11 and the upper die 21 are engaged while the press-formed workpiece W is sandwiched therebetween. As a result, while operating liquid is almost absent between the lower die 11 and the press-formed workpiece W, a number of projections and recesses W1*a* are shaped as required as shown in FIG. 9 by means of the upper die 21 and the lower die 11. Also, in this state, since the supply of operating oil of a predetermined pressure to the pressure chambers R1 is continued, the lower die 11 is held at a position located above the bottom dead center by a predetermined amount (0.5–1.0 mm).

In the strain removing step shown in FIG. 10, in the state in which operating oil can be relief-drained from the pressure chambers R1, the upper die 21 and the lower 11 are lowered (in the direction of the arrow of FIG. 10) from the position of FIG. 8 by a predetermined amount (0.5–1.0 mm). As a result, while the projections and recesses W1*a* of the press-formed workpiece W are sandwiched between the lower die 11 and the upper die 21 (while the press-formed workpiece W is maintained in a pressed state), the peripheral portion W2 surrounding the central portion W1 of the press-formed workpiece W is drawn away from the central portion W1. Thus, the peripheral portion W2 of the press-formed workpiece W is plastically deformed to thereby remove strain from the press-formed workpiece W.

By use of a cutting machine (not shown), the thus-manufactured press-formed workpiece W of FIG. 11 is cut at a predetermined position located in the peripheral portion W2 so as to cut off the peripheral edge portion W3, and through-holes are formed in the peripheral portion W2, thereby yielding, as a product, a flat separator Wo for use in a fuel cell.

As described above, according to the present embodiment, the peripheral portion W2 surrounding the central portion W1 of the press-formed workpiece W is drawn away from the central portion W1 while the press-formed workpiece W is maintained in a pressed state established by means of the upper die 21 and the lower die 11, whereby plastic deformation is imparted to the press-formed workpiece W to thereby remove strain from the press-formed workpiece W. Thus, strain can be readily removed from the press-formed workpiece W, simply by means of subjecting the press-formed workpiece W to drawing while the press-formed shape of the press-formed workpiece W is maintained intact (while the press-formed workpiece W is maintained in a pressed state).

According to the present embodiment, while the peripheral edge portion W3 is clamped by means of the die 12 and the blank holder insert 28 of the forming press 100, and the central portion W1 of the press-formed workpiece W is partially held by means of the upper die 21 and the lower die 11 (the projections and recesses W1*a* are held), which are used to press-form a blank into the press-formed workpiece W, the upper die 21 and the lower die 11 are moved downward (in the press direction) to thereby remove strain from the press-formed workpiece W. Thus, the strain removing step shown in FIG. 10 (the step of drawing in the press direction) can be readily incorporated into the press-forming process shown in FIGS. 2 to 9.

The press-formed workpiece W is a thin metal plate having a number of projections and recesses W1*a* formed at the central portion W1. The amount of lowering movement in the strain removing step shown in FIG. 10 (the amount of drawing) is substantially equal to a difference in a sectional length of the press-formed workpiece W (La-Lb) which arises from local presence and absence of the projections and recesses W1*a*. Employment of the thus-determined amount of drawing allows formation of a number of projections and recesses W1*a* on the thin metal plate without involvement of cracking of the thin metal plate. Therefore, strain can be removed from the press-formed workpiece W without involvement of cracking of the press-formed workpiece W. Further, since the peripheral edge portion W3, in which the influence of strain-removing work remains to a great extent, is cut off from the press-formed workpiece W which has undergone the drawing work, to thereby yield a platelike product, the influence of strain-removing work hardly remains in the obtained platelike press-formed product.

In the forming press 100 of the present embodiment, the upper die 21 lowers toward the lower die 11 so as to press-form the central portion W1 of a workpiece, and the cushion mechanism A is disposed under the lower die 11 so as to allow a lowering movement of the upper and lower dies 11 and 21. Thus, the cushion mechanism A can be compactly incorporated into the forming press 100 under the lower die 11.

As shown in FIG. 10, edge portions of a press die; i.e., edge portions of the die 12 and upper die 21, are rounded, the edge portions being in contact with the press-formed workpiece W in a relatively movable manner when the peripheral portion W2 surrounding the central portion W1 of the press-formed workpiece W is drawn away from the central portion W1. This rounding allows smooth relative movement between the press die (the die 12 and the upper die 21) and the press-formed workpiece W, whereby strain can be smoothly removed from the press-formed workpiece W.

According to the above-described embodiment, the cushion mechanism A is disposed under the lower die 11; and while the peripheral edge portion W3 is clamped by means of the die 12 and the blank holder insert 28, and the central portion W1 of the press-formed workpiece W is partially held by means of the upper die 21 and the lower die 11, the upper die 21 and the lower die 11 are moved downward to thereby draw the peripheral portion W2 surrounding the central portion W1 of the press-formed workpiece W away from the central portion W1 for removing strain from the press-formed workpiece W. However, the present invention is not limited thereto. For example, strain can be removed from the press-formed workpiece W in the following manner: while the central portion W1 of the press-formed workpiece W is partially held by means of the upper die 21 and the lower die 11, the peripheral portion W2 and peripheral edge portion W3 of the press-formed workpiece W are moved outward (laterally) to thereby draw the peripheral portion W2 of the press-formed workpiece W away from the central portion W1 thereof.

Obviously, numerous modifications and variations of the present invention are possible in light of the above teachings. It is therefore to be understood that within the scope of the appended claims, the present invention may be practiced otherwise than as specifically described herein.

What is claimed is:

1. A method for removing strain from a press-formed workpiece which is obtained by pressing a blank in a press direction, while fixing a peripheral edge portion of the blank, by use of a forming press, wherein said workpiece has a shape of the whole press-formed portion which will remain later as a product made from the press-formed workpiece and is complete as a shape of the product, comprising a step of:

partially holding a central portion, including the whole press-formed portion which will remain as the product, of the press-formed workpiece and moving the central portion in the press direction, while fixing a peripheral edge portion on of the press-formed workpiece corresponding to the peripheral edge portion of the blank, so as to draw a peripheral portion, surrounding the central portion, of the press-formed workpiece away from the central portion, for imparting plastic deformation to the press-formed workpiece, to thereby remove stain from the press-formed workpiece.

2. A method for removing strain from a press-formed workpiece according to claim 1, wherein the press-formed workpiece is a thin metal plate having a number of projections and recesses formed at the central portion thereof.

3. A method for removing strain from a press-formed workpiece according to claim 2, wherein the product yielded from the press-formed workpiece is a separator for use in a fuel cell.

4. A method for removing strain from a press-formed workpiece according to claim 2, Wherein an amount of drawing is substantially equal to a difference between a sectional length as measured at a portion of the press-formed workpiece where the projections and recesses are present and a sectional length as measured at a portion of the press-formed workpiece where the projections and recesses are absent.

5. A method for removing strain from a press-formed workpiece according to claim 1, further comprising cutting off the peripheral edge portion from the press-formed workpiece which has undergone said drawing, so as to yield the platelike product.

6. A method for removing strain from a press-formed workpiece according to claim 1, wherein the press-formed workpiece is made of a metal plate having a thickness not greater than 0.5 mm.

* * * * *